US011280097B2

(12) United States Patent
Kenyon

(10) Patent No.: US 11,280,097 B2
(45) Date of Patent: Mar. 22, 2022

(54) LADDER-BASED WINCH-POWERED PLANK SCAFFOLD

(71) Applicant: Brian Kenyon, Pasadena, CA (US)

(72) Inventor: Brian Kenyon, Pasadena, CA (US)

( * ) Notice: Subject to any disclaimer, the term of this patent is extended or adjusted under 35 U.S.C. 154(b) by 0 days.

(21) Appl. No.: 16/987,940

(22) Filed: Aug. 7, 2020

(65) Prior Publication Data

US 2021/0040749 A1 Feb. 11, 2021

Related U.S. Application Data

(60) Provisional application No. 62/883,985, filed on Aug. 7, 2019.

(51) Int. Cl.

| | |
|---|---|
| ***E04G 1/38*** | (2006.01) |
| ***E04G 5/04*** | (2006.01) |
| ***E04G 1/15*** | (2006.01) |
| ***E04G 1/18*** | (2006.01) |
| *E04G 5/00* | (2006.01) |

(52) U.S. Cl.

CPC ..... *E04G 1/38* (2013.01); *E04G 1/15* (2013.01); *E04G 1/18* (2013.01); *E04G 5/04* (2013.01); *E04G 2005/008* (2013.01)

(58) Field of Classification Search

CPC .... E04G 1/15; E04G 1/18; E04G 1/38; E04G 5/04; E04G 2005/008; E06C 7/12; E06C 7/16; E06C 7/48; E06C 7/482; E06C 7/484

See application file for complete search history.

(56) References Cited

U.S. PATENT DOCUMENTS

| | | | | | |
|---|---|---|---|---|---|
| 623,269 | A * | 4/1899 | Wilber | E06C 7/16 | 182/103 |
| 731,708 | A * | 6/1903 | Quinn | E06C 7/12 | 182/102 |
| 738,164 | A * | 9/1903 | Cody | E06C 7/12 | 182/102 |
| 799,782 | A * | 9/1905 | Ellinger | E06C 7/48 | 182/214 |
| 1,692,664 | A | 11/1928 | Kirsch | | |
| 2,212,384 | A * | 8/1940 | Brandel | B66C 23/203 | 248/210 |
| 2,359,868 | A | 10/1944 | Mick | | |
| 2,459,621 | A * | 1/1949 | Cobb | E06C 7/12 | 248/210 |

(Continued)

FOREIGN PATENT DOCUMENTS

DE 2022057 A1 * 11/1971 ..... B66B 9/187

*Primary Examiner* — Colleen M Chavchavadze
(74) *Attorney, Agent, or Firm* — SoCal IP Law Group LLP; Guy Cumberbatch; Steven Sereboff

(57) ABSTRACT

A plank scaffold system and, more particularly, to a ladder-based vertically-adjustable plank scaffold system. The system may have a pair of ladders, a wall standoff mounted at the top of each of the ladders, a crane support mounted at the top of each of the ladders, a vertical guide bar and roller system to keep it from swinging on the cables, and a horizontal platform suspended on cables below the crane supports, the platform having a pair of cable winches mounted thereon for varying the elevation of the platform. Instead of ladders, tower scaffolds or stage towers may be used on each side to support the vertically-adjustable plank.

16 Claims, 17 Drawing Sheets

(56) References Cited

U.S. PATENT DOCUMENTS

| | | | | | |
|---|---|---|---|---|---|
| 2,663,484 | A | | 12/1953 | MacPherson | |
| 2,710,129 | A | * | 6/1955 | Telech | E06C 7/48 182/214 |
| 2,809,804 | A | | 10/1957 | Sheard | |
| 2,890,082 | A | | 6/1959 | McDaniel et al. | |
| 2,908,345 | A | * | 10/1959 | Lund | E06C 7/16 182/214 |
| 3,115,211 | A | * | 12/1963 | Ostrander, Jr. | E06C 7/12 182/103 |
| 3,425,510 | A | | 2/1969 | Fedpryk | |
| 3,454,132 | A | | 7/1969 | Platino et al. | |
| 3,708,080 | A | | 1/1973 | Schlei | |
| 3,734,236 | A | | 5/1973 | Houtler | |
| 3,743,227 | A | * | 7/1973 | Sowery | E06C 7/12 248/210 |
| 3,854,550 | A | | 12/1974 | Shingler | |
| 3,902,700 | A | | 9/1975 | Cox | |
| 3,967,696 | A | * | 7/1976 | Nix | E04G 3/30 182/142 |
| 4,232,759 | A | | 11/1980 | Jacobs | |
| 4,598,795 | A | * | 7/1986 | Larson | E06C 7/48 182/129 |
| 4,650,035 | A | * | 3/1987 | Eubanks | E06C 7/12 182/101 |
| 4,770,273 | A | * | 9/1988 | McMakin | B66B 9/16 182/102 |
| 5,152,369 | A | * | 10/1992 | Nakaoka | B66B 9/187 182/129 |
| 5,427,356 | A | * | 6/1995 | Krotov | B66C 19/02 182/129 |
| 6,761,246 | B2 | * | 7/2004 | Bowles | E04G 1/30 182/117 |
| 9,487,380 | B2 | * | 11/2016 | Hanley | B66D 1/12 |
| 10,421,651 | B1 | * | 9/2019 | Coleman | B66C 23/203 |
| 2003/0019689 | A1 | * | 1/2003 | Dorsett | E06C 7/12 182/129 |

* cited by examiner

LADDER-BASED WINCH-POWERED PLANK SCAFFOLD

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner have no objection to the facsimile reproduction by anyone of the patent disclosure as it appears in the Patent and Trademark Office patent files or records, but otherwise reserves all copyright and trade dress rights whatsoever.

RELATED APPLICATIONS

The present application claims priority to provisional application No. 62/883,985 filed Aug. 7, 2019, under the same title, which is incorporated herein by reference in its entirety.

BACKGROUND

Field

This disclosure relates to a plank scaffold system and, more particularly, to a ladder-based vertically-adjustable plank scaffold system.

Description of the Related Art

Swing Stage platform scaffolds are ubiquitous in cities, where they are suspended from tall building roofs and two cable winches on board operating in tandem gradually lower the platform down the building exterior for window washing and other tasks. For jobs on the outside of smaller structures, such as painting and window washing, a portable scissor lift is often used. However, such a system is relatively expensive to lease and thus not economic for small jobs. In other systems, parallel tall ladders with scaffolding in between have been proposed. For instance, a mobile ladder-scaffolding system seen in U.S. Pat. No. 4,232,759 involves two rigidly fixed ladders that are laterally movable along tracks and support a platform at various elevations. This system is relatively complicated and requires guiding structure on the roof of the building on which the work is being done.

Despite numerous solutions proposed for smaller platform scaffolds, there remains a need for an easy-to-use and economical system that may be set up by one or two workmen.

SUMMARY OF THE INVENTION

According to exemplary embodiments, a ladder-based winch-powered plank scaffold is provided. The ladder-based vertically-adjustable plank scaffold system may have a pair of ladders, a wall standoff mounted at the top of each of the ladders, a crane support mounted at the top of each of the ladders, and a horizontal platform suspended on cables below the crane supports, a roller guide bar to keep the platform from swinging, the platform having a pair of cable winches mounted thereon for varying the elevation of the platform. Instead of ladders, tower scaffolds or stage towers may be used on each side to support the vertically-adjustable plank.

One version modifies the standoff legs to be telescopic so they are shorter when not in use so as not to throw off your balance when lifting or carrying ladders vertically during setting up the scaffold.

Another useful variation is to extend the crane arm all the way to the wall, bend it downward and connect it to the roller guide bar. This eliminates the upper stabilizer bar and also functions to bear some of the weight so the standoffs do not bear it all.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION

Figure 1A:
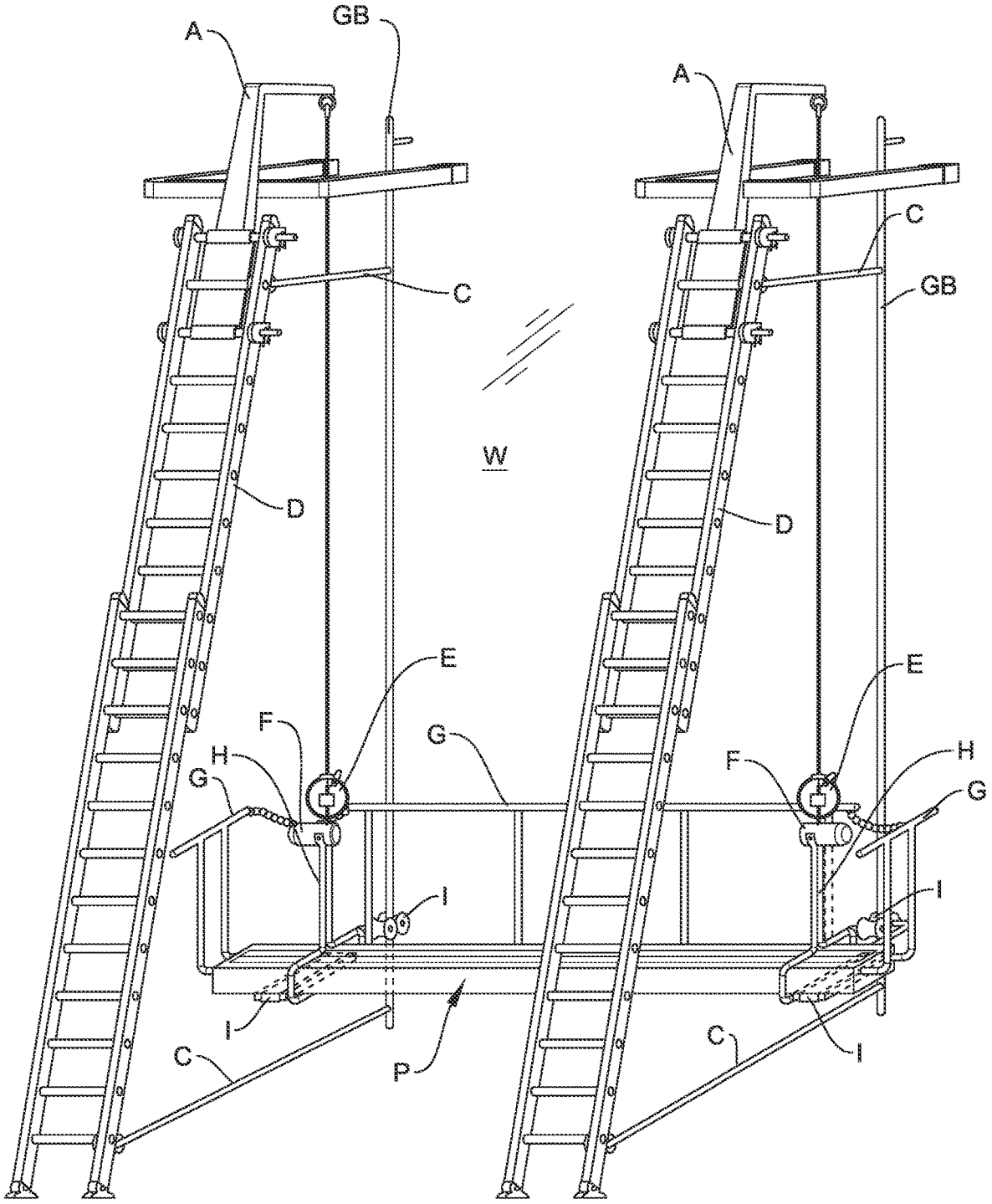
FIG. 1A is a perspective view of an embodiment of a ladder-based plank scaffold system embodying aspects of the present application.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, etc., are used for convenience in referring to such component, apparatus, location, feature, or a portion thereof in the drawings and are not intended to be limiting.

Furthermore, unless otherwise stated, any specific dimensions or specified thickness of materials mentioned in this description are merely representative of an exemplary implementation of a device embodying aspects of the invention and are not intended to be limiting.

Figure 1B:
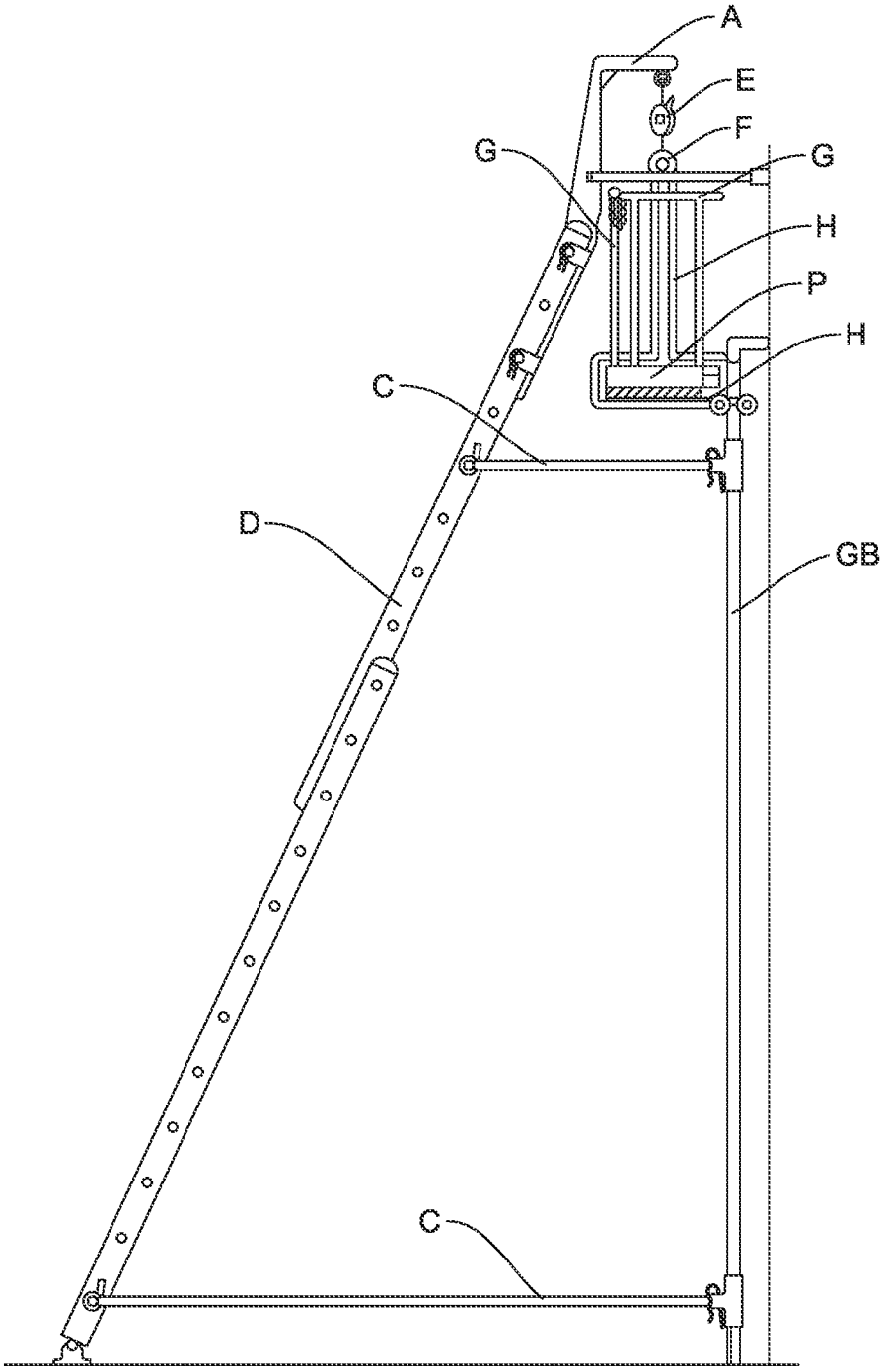
FIG. 1B is a side elevational view thereof.

FIG. 1A is a perspective view of an embodiment of a ladder-based plank scaffold system embodying aspects of the present application, and FIG. 1B is a side elevational view thereof. Key components of the system are indicated by letter symbols which correspond to descriptors provided below. The system is adapted to be deployed against a vertical wall W of varying heights, but typically no more than three stories tall, or about 21 feet. Practically speaking, standard 12' extension ladders extend to 21', which places the plank suspended below the top at about 16'. Of course, the present system can be scaled up to accommodate taller buildings, as permitted by regulation, though a typical system will have components that are small enough to be collapsed and transported in a standard work truck and deployed without special equipment. In a preferred embodiment, the system is portable, can be carried on a small truck, put up/taken down by one person in 30-45 minutes, and can bear at least 700 lbs.

The ladder-based plank scaffold system features two extension ladders D that are propped up against the wall W and spaced apart between 16-25 feet. A pair of loadbearing standoffs A that are secured at the top of each of the ladders D space the top end of the ladders away from the wall.

The wall standoffs A mount at the top of each of the ladders D and having a sufficient length to extend from the respective ladder to the adjacent vertical wall W. A crane support is fixedly connected to and positioned adjacent the top of each of the ladders, and a horizontal platform P is suspended on cables below the crane supports. The platform P has a pair of cable winches F mounted thereon for varying the elevation of the platform.

The wall standoff A and the crane support may be integrated into one structural piece. Each wall standoff A includes a vertical column with two ladder rung braces spaced to rest on top of different rungs of the ladder on which the wall standoff mounts. Each wall standoff includes a horizontal portion extending toward the adjacent vertical wall and terminating at a cable attachment ring, wherein the cables for the cable winches are secured to the cable attachment ring. Upper and lower horizontal stabilizer bars extend from spaced points on each ladder D and connect firmly to a vertical roller guide bar GB positioned adjacent the vertical wall W, the horizontal platform P has a pair of roller assemblies I each of which engages and is configured to slide or roll up and down along one of the roller guide bars. The roller guide bar GB thus stabilize the platform P from rocking due to wind or other environmental factors.

Descriptors for FIGS. 1A and 1B:

A) Load-bearing standoff with crane. (Two versions, FIG. 2A, 2B)

GB) Roller guide bar (e.g., 2 inch aluminum pipe, 3/16 inch thick, or 2.5 inch aluminum square tube 1/8 inch thick).

C) Stabilizer bars (e.g., 1½ inch aluminum pipe, 3/16 inch thick).

D) Standard heavy-duty 12 foot extension ladders.

E) Cable fall breaks, standard commercial.

F) Electric winch, rechargeable.

G) Safety railings (e.g., 1½ inch aluminum pipe, 3/16 inch thick).

H) Plank frame (e.g., 1½ inch aluminum pipe, 3/16 inch thick).

Figure 3A:
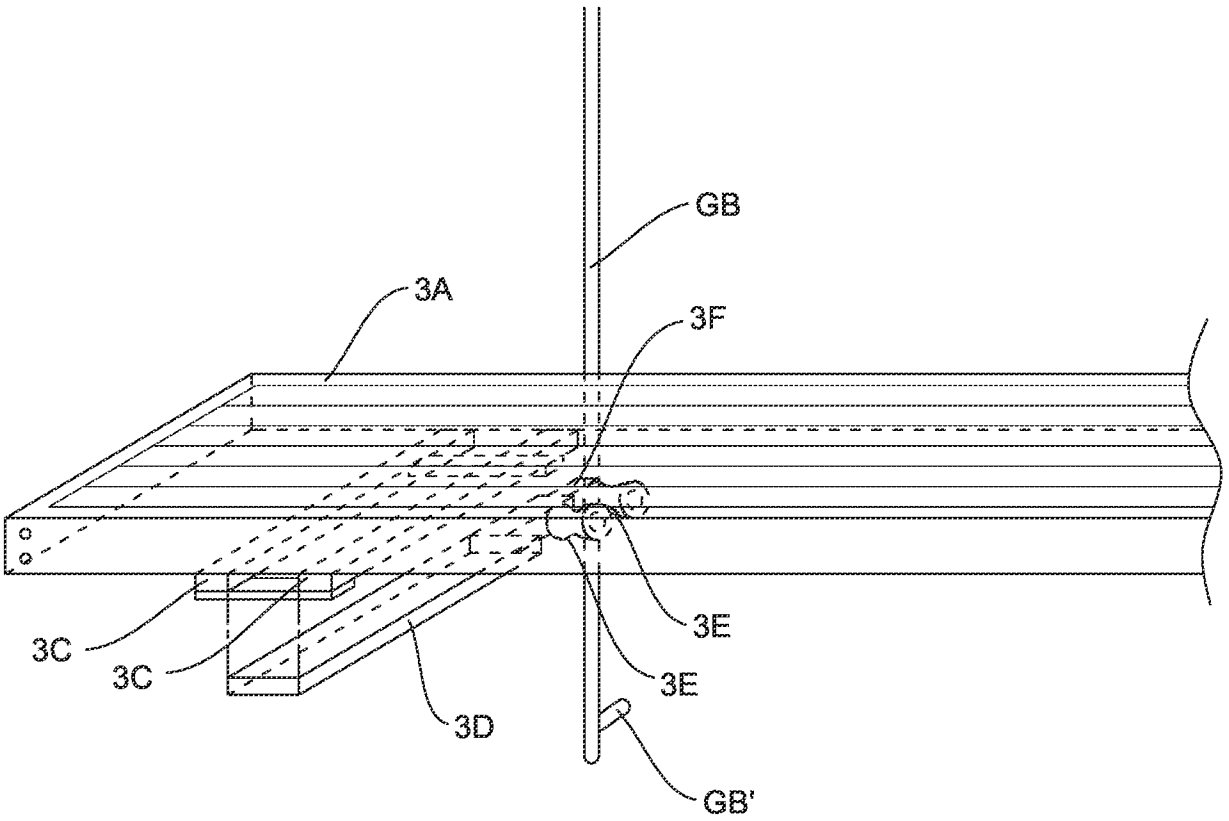
FIG. 3A is a perspective view of an exemplary plank roller assembly used in the ladder-based plank scaffold system of the present application with a guide bar in the form of a round pipe engaged by concave rollers.
Figure 3B:
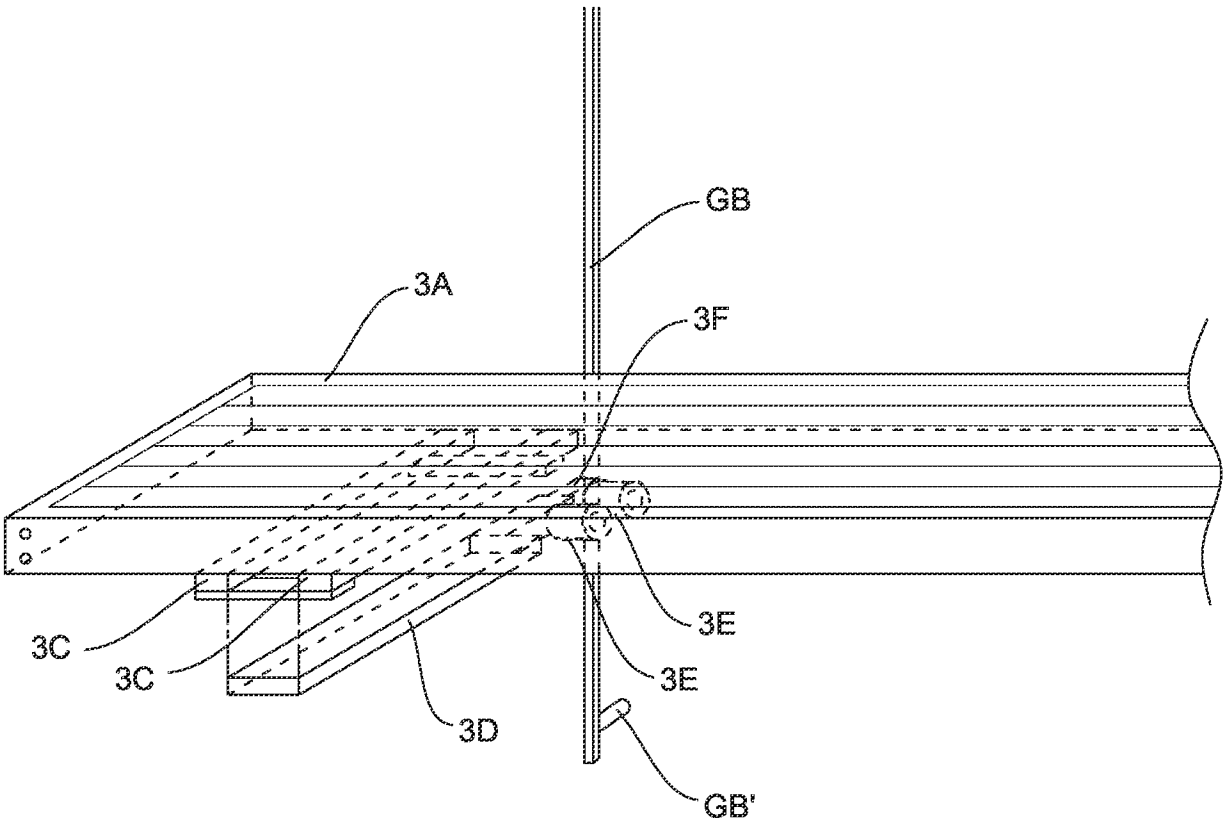
FIG. 3B is a variation using square tubing and flat rollers.

I) Roller assembly, (see detail of FIGS. 3A and 3B).

Figure 2A:
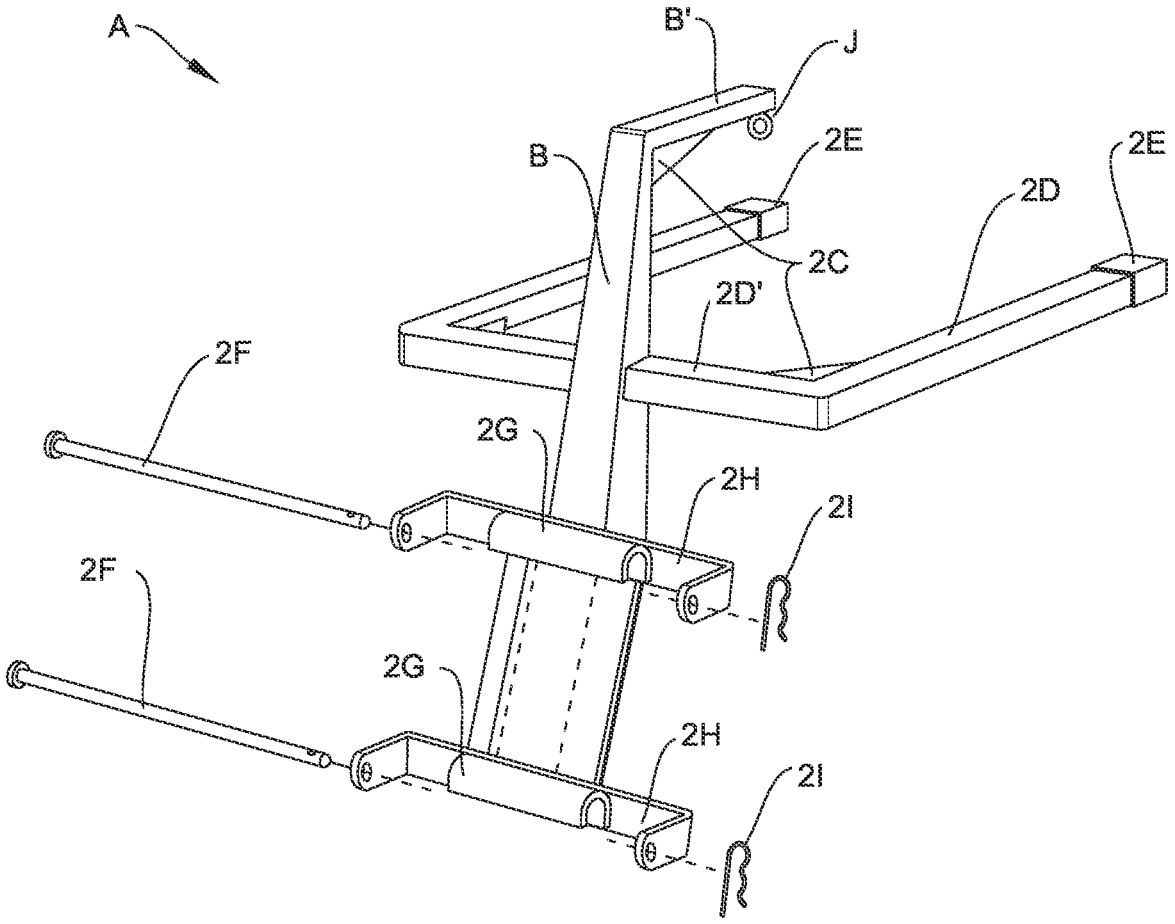
FIG. 2A is a perspective view of an exemplary weight-bearing standoff used in the ladder-based plank scaffold system of the present application.

An exemplary standoff A is illustrated in FIG. 2A and generally features brackets for connecting to the top of the ladders, a vertical column or crane extension B having a cantilevered horizontal component B' extending toward the wall W, and a pair of standoff arms 2D that come in contact with the wall. The standoff arms 2D are connected to a mid-point of the crane extension B by horizontal components 2D'. The standoff arms 2D give the ladder wider upper contact points with the wall, and typically space the top of the ladder away from wall by 2 feet or more. Reinforcing plate gussets 2C are typically welded at angles of the components of the standoff A for strength. The standoff A is typically formed of aluminum as with most extension ladders for weight savings.

Each standoff A has a lower portion that is angled with respect to the upper crane B. The lower portion has a pair of ladder rung braces in the form of inverted arcuate gussets 2G spaced to rest on top of different rungs of the ladder, and a pair of side lace plates 2H for each of the ladder rung braces 2G with apertures for passage of an elongated cotter pin 2F to lock the wall standoff to the ladder, as seen in FIG. 1A. The cotter pins pass through the respective rungs and the outer lace plates 2H to hold the standoff A in place. The lace plates 2H are shown spanning three rungs (1-3) and the rung braces 2G and cotter pins are associated with spaced apart rungs 1 and 3 for more strength, though they could be provided on rungs 1 and 2, or 1 and 4, or all three rungs 1, 2 and 3.

As indicated in the exemplary embodiment of FIG. 2A, the standoff arms 2D may have a length of 25 inches or more as allowed by regulations, and the upper rung brace or gusset 2G of the standoff A hangs on the top rung of the ladder D (FIG. 1A) so that there is enough space for the plank frame to rise as high as needed to get the plank to full height (e.g., 16'). The horizontal component B' of the crane extension B terminates in a cable attachment ring J through which a cable is passed, whose purpose will be clear below.

Figure 2B:
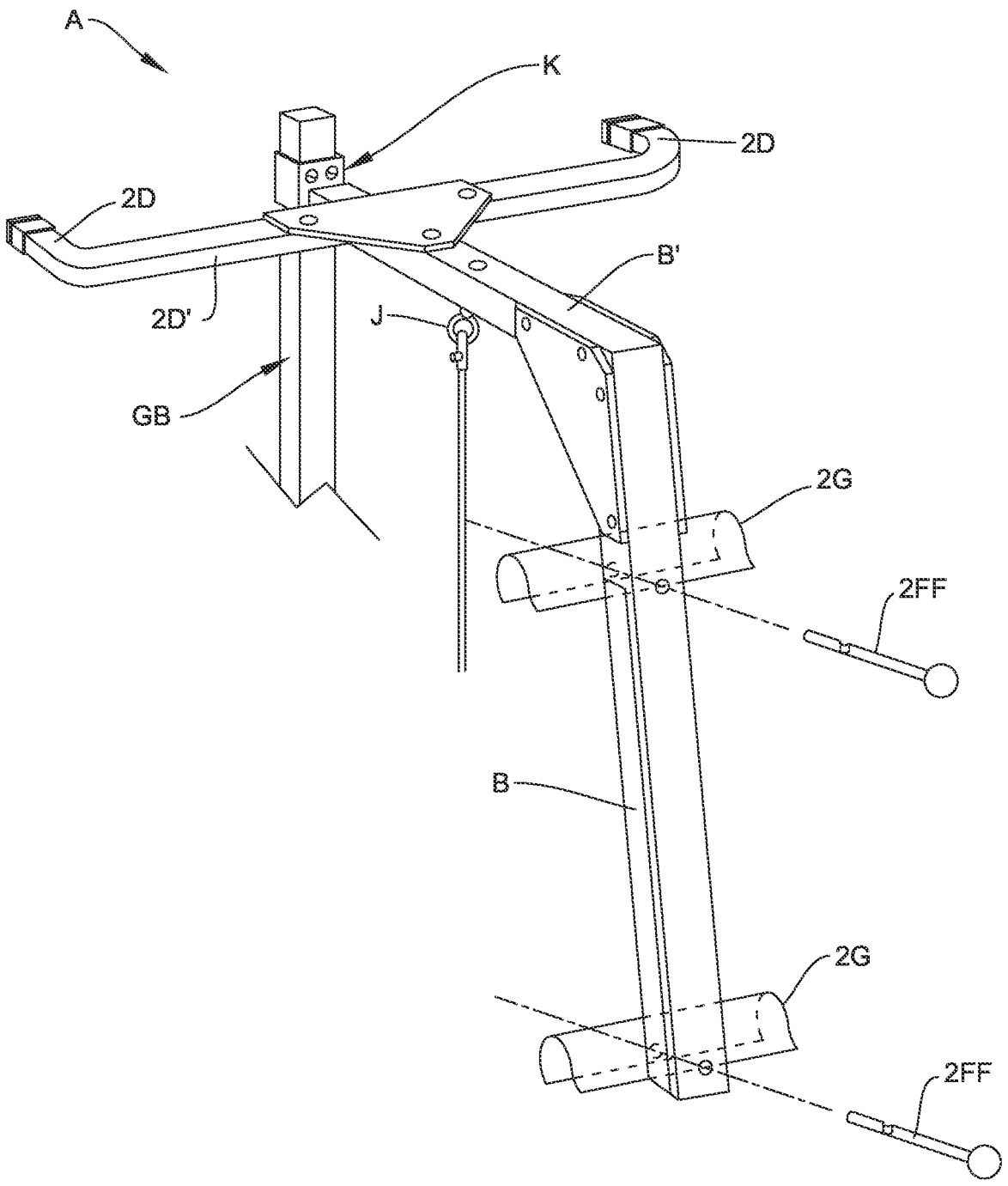
FIG. 2B is an alternative weight-bearing standoff.

FIG. 2B is an alternative weight-bearing standoff A which integrates the crane extension B with the standoff arms 2D. More particularly, the crane extension B has a vertical column, as before, with a horizontal component B' attached to a top end and extending toward the wall W. The standoff arms 2D including a common horizontal component 2D' attached to a free end of the horizontal component B'. Due to the horizontal component B' of the crane extension B, the standoff arms 2D are significantly shorter than those in the embodiment of FIG. 2A.

Furthermore, the cable attachment ring J is positioned along the horizontal component B' of the crane extension B which is no longer cantilevered, due to the bracing effect of the standoff arms 2D against the wall W. This helps distribute the weight of the platform, workers and materials more evenly as opposed to a cantilevered crane extension.

The standoff A further may include a lower portion that is angled and has a pair of ladder rung braces in the form of inverted arcuate gussets 2G spaced to rest on top of different rungs of the ladder. Lace pins 2FF may be used to pass through apertures in the gussets 2G and through the respective rungs to hold the standoff A in place.

The horizontal component B' of the crane extension B may further terminate in a fastener bracket K, such as a square tube as shown, that is sized to be secured to a top end of a roller guide bar GB. The horizontal component B' thus takes the place of an upper horizontal stabilizer bars C such as seen in the embodiment of FIG. 1A.

Descriptors for FIGS. 2A and 2B:

A) Load-bearing standoff with crane.

B) Crane extension.

2C) Gussets, strength reinforcements.

2D) Standoff arms, (approximately 25" long).

2E) Standoff feet, rubber/standard.

2F, 2FF) Through ladder rung, lace pins.

2G) Over rung standoff mounts, Ladderjack adapted/standard.

2H) Exterior ladder side lace plates.

2I) Cotter clips for lace pins.

J) Cable attachment ring.

K) Fastener bracket.

GB) Roller guide bar.

With reference back to FIGS. 1A and 1B, cables extend down from the two standoffs A to electric winches F mounted on a vertically-adjustable plank P. An operator standing on the plank P can control the height of the plank by actuating the electric winches F. It should be noted that there are also cable drop brakes E mounted above the winches F, which will stop a freefall and are tripped if the cable goes too fast.

The system is stabilized from swaying excessively by a series of bars connected between the ladders D and platform P. In particular, horizontal stabilizer bars C extend from the upper and lower ends of the ladders D two vertical roller or guide bars GB positioned against the wall W. Small spacers such as horizontal pipe lengths may be provided between the guide bars GB and the wall. The guide bars GB are also received in roller assemblies I extending horizontally toward the wall W from the platform P. In this way, the components of the system are integrated stabilized against oscillations caused by the wind or other disturbances.

FIGS. 3A and 3B are perspective views of an exemplary plank roller assembly used in the ladder-based plank scaffold system of the present application. In the exemplary embodiment, the guide bar GB extends between a pair of concave rollers 3E (or flat rollers) so that the platform P is guided smoothly up and down adjacent wall W. Previously used swing stages have had a problem in that when working on one you must not touch or lean on the wall because you are hanging on ropes or cables, and if you do, it swings away from the wall. The illustrated stabilizer bars GB', C ensure that the angle of the ladder is always the same (from Vertical Guide bar to ladder) and the distance between ladders also stay the same (from ladder to ladder.) It should be understood that the vertical roller or guide bars GB may be formed from several types of rigid lengths, most commonly round pipe or square tube, though solid and other cross-sections are possible. Also, some standard scaffold planks have premade mounting methods for roller wheels which may be used if practicable.

Descriptors for FIGS. 3A and 3B:

3A) Aluminum scaffold plank (e.g., 6"×14"×20' max, holds 750 pounds).

GB) Roller guide bar (e.g., 2" aluminum pipe, 3/16 inch thick or 2.5 inch square tube, 1/8 inch thick).

3C) Roller assembly attachment sleeve.

Figure 4A:
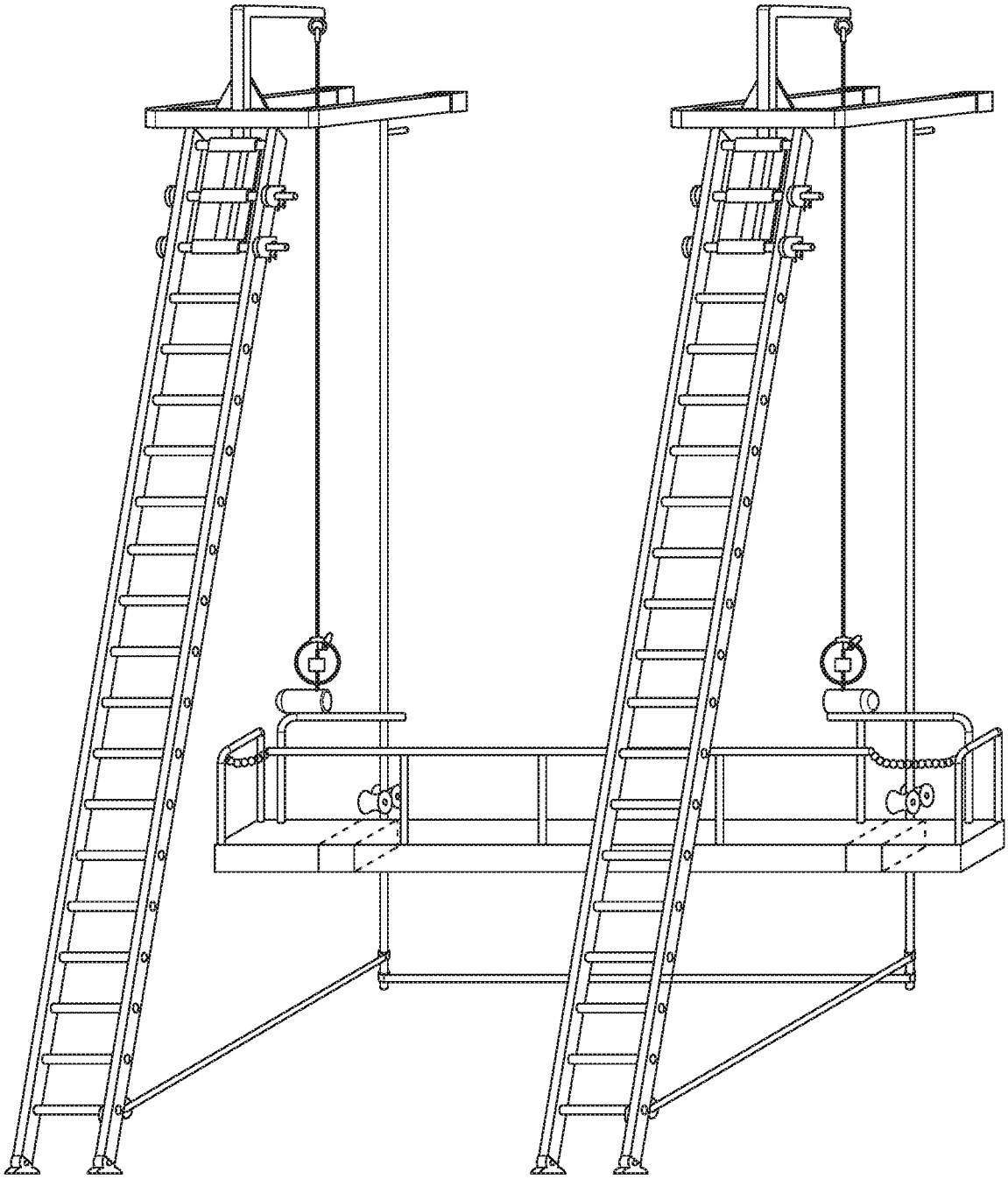
FIG. 4A is a perspective view of an alternative ladder-based plank scaffold system of the present application.
Figure 4B:
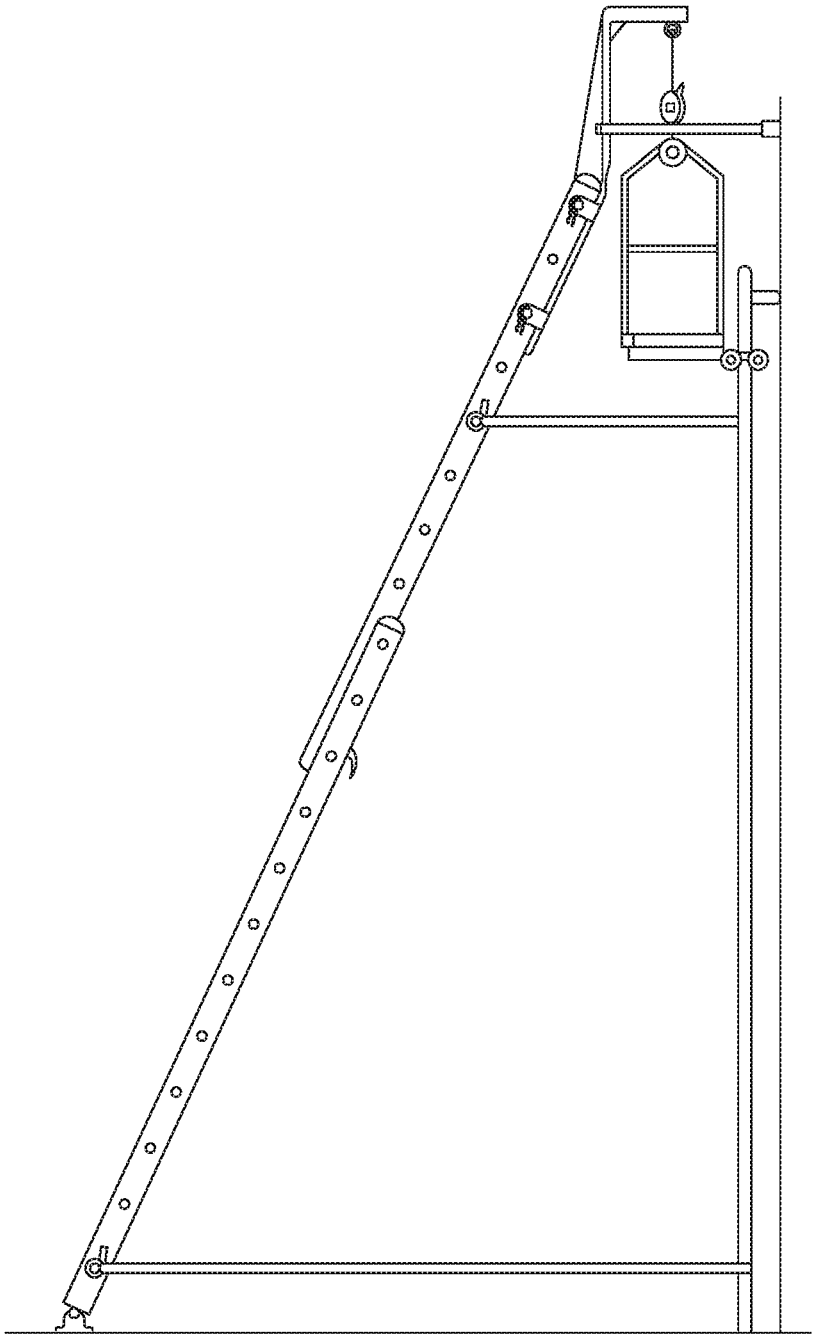
FIG. 4B is a side elevational view thereof.
Figure 4C:
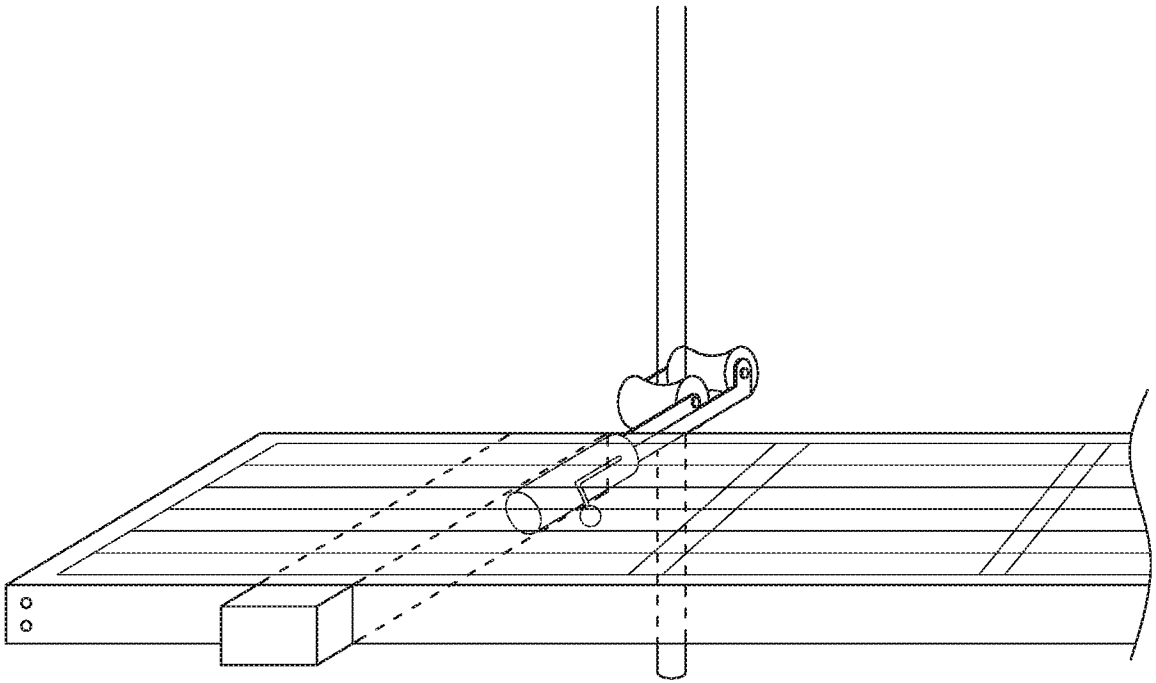
FIG. 4C is a perspective view of a stabilizer/roller assembly incorporated therein.

3D) Roller assembly (see detail FIG. 4C).

3E) Rollers.

3F) Rollers extension bar.

GB') Roller guide bar stabilizer (e.g., 2" aluminum pipe, 3/16 inch thick or 2.5 inch square aluminum tube, 1/8 inch thick).

Figure 4D:
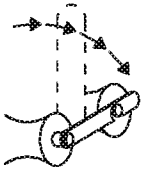
FIG. 4D illustrates additional structural details.

FIGS. 4A and 4B illustrate an alternative ladder-based plank scaffold system of the present application, FIG. 4C is a perspective view of a stabilizer/roller assembly incorporated therein. The system is generally similar to that described above, but includes plank stabilizers for greater security. FIG. 4D illustrates additional structural details, in particular each roller assembly includes a pair of rollers that are movable with respect to one another to enable each pair of rollers to be assembled over one of the roller guide bars.

Figure 5:
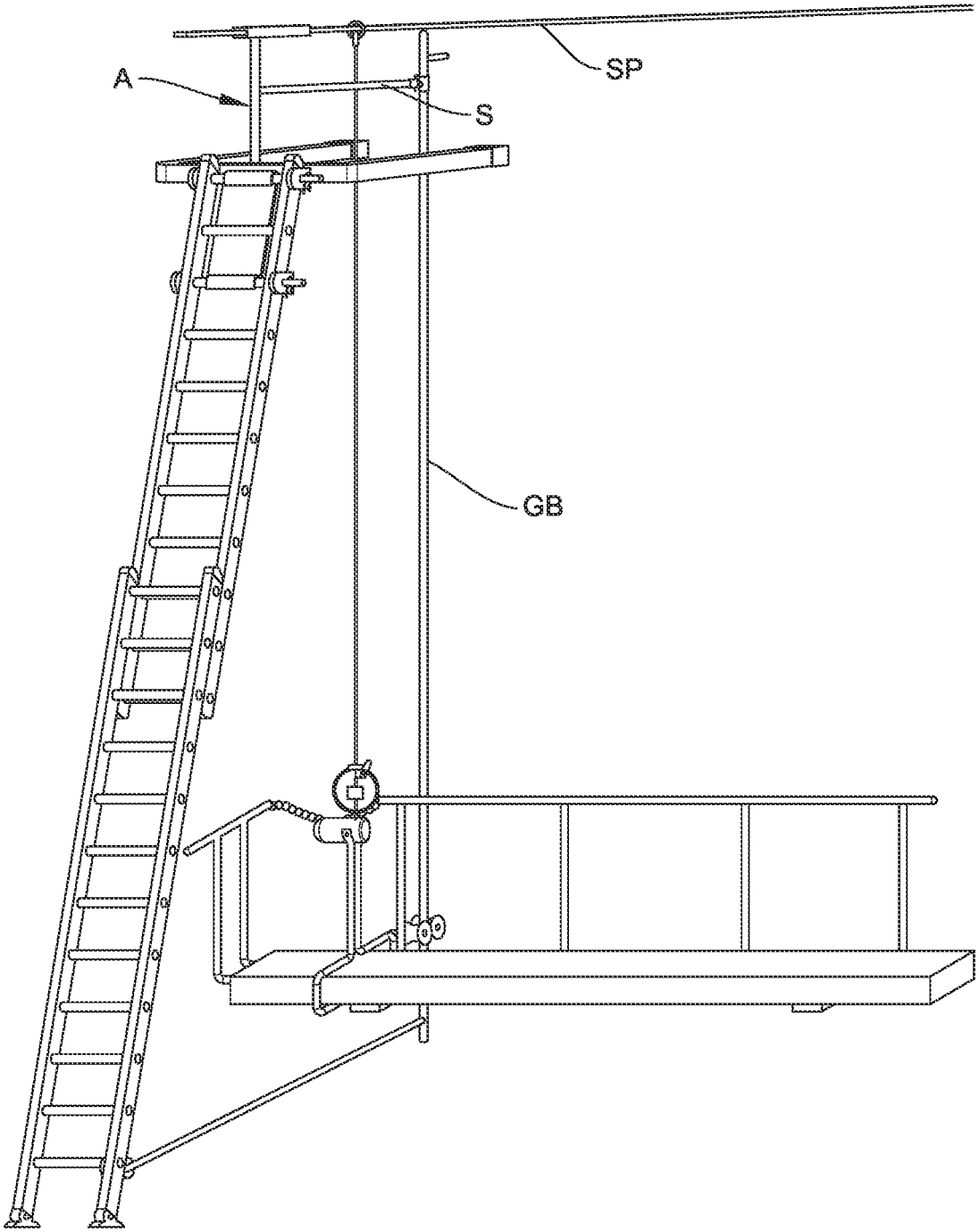
FIG. 5 is a perspective view of another alternate embodiment of a ladder-based plank scaffold system.

FIG. 5 is a perspective view of another alternate embodiment of a ladder-based plank scaffold system. In this variation, a horizontal stabilizer pole SP is mounted between the crane extensions extending upward on the standoffs A for both ladders and to which the cables connect. This allows for easier setup as opposed to suspending the cables from the standoffs. In addition, the weight bearing standoff A is connected directly to the vertical guide bar GB via a horizontal strut S. The vertical guide bar GB goes down to the ground so therefore the weight of the cables, brakes, winch, plank frame and planks are now distributed not only to the weight bearing standoffs A but also to that guide bar GB (and the ground), cutting the weight stress to the standoff A basically in half. Rather than using a separate horizontal stabilizer pole SP, the crane arm may extend all the way to the wall and bend downward so as to connect to the roller guide bar GB.

Figure 6A:
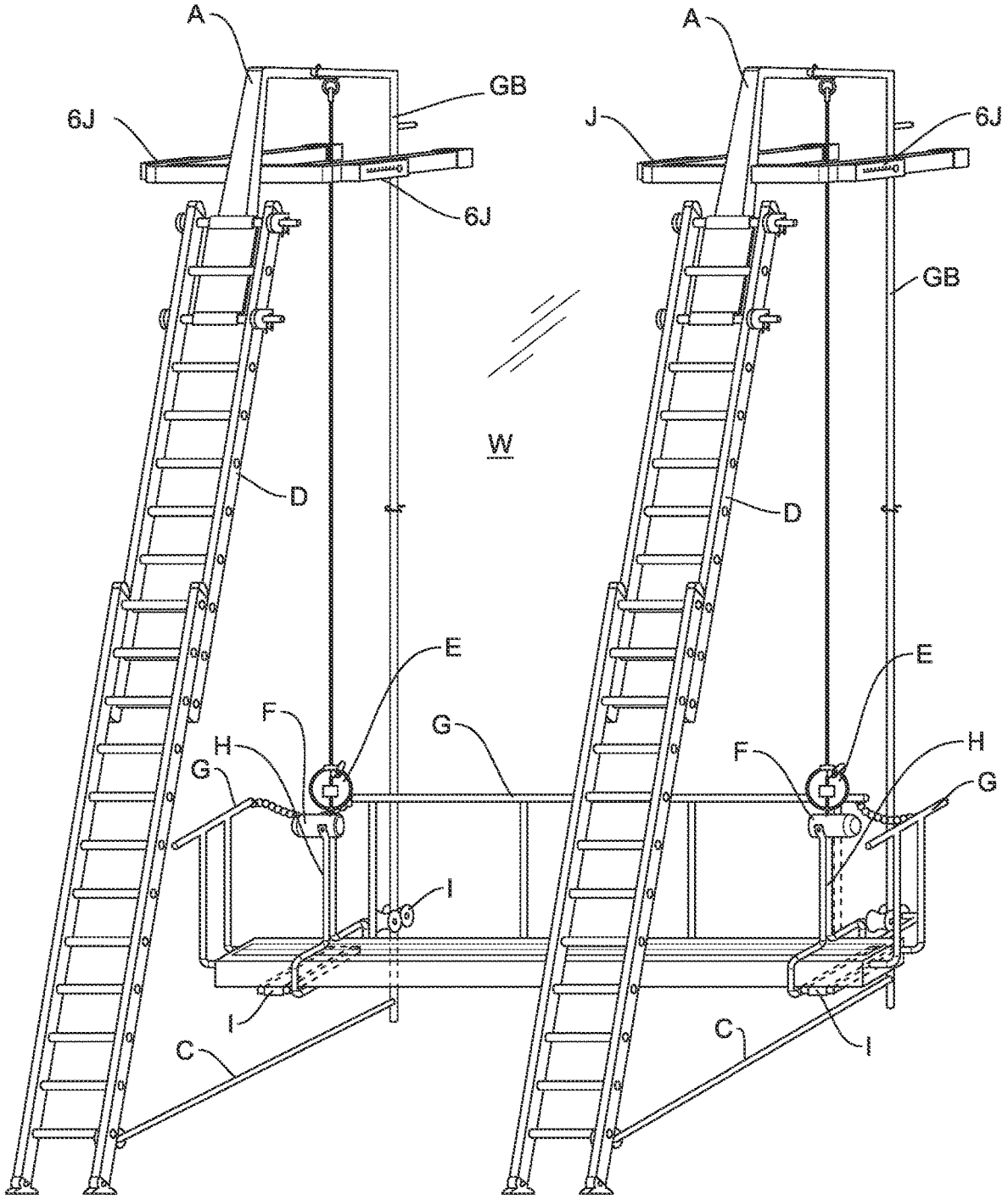
FIG. 6A is a perspective view of a still further alternative ladder-based plank scaffold system with telescoping standoff arms.
Figure 6B:
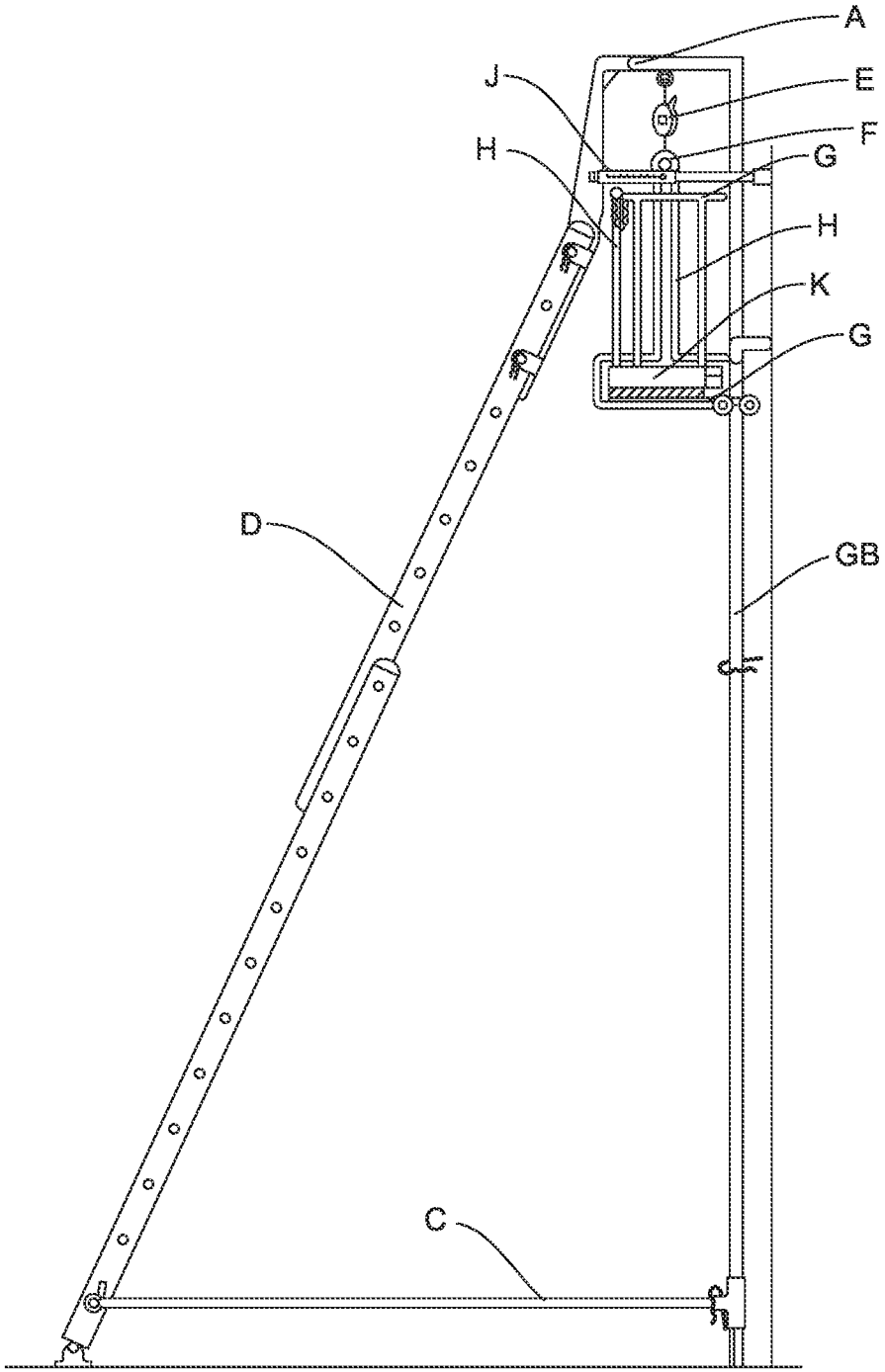
FIG. 6B is a side elevational view thereof.

FIG. 6A is a perspective view of a still further alternative ladder-based plank scaffold system with telescoping standoff arms 6J, and FIG. 6B is a side elevational view thereof. This arrangement allows the standoffs A to be spaced variable distances away from the wall W. FIG. 6A also shows a version of the alternate standoff A of FIG. 2B in which the horizontal component connects to the roller guide bar GB.

Descriptors for FIGS. 6A and 6B:

A) Load-bearing standoff with crane (connected to roller guide bar GB).

GB) Roller guide bar (e.g., 2 inch aluminum pipe, 3/16 inch thick or 2.5 inch square aluminum tube, 1/8 inch thick).

C) Stabilizer bars (e.g., 1½ inch aluminum pipe, 3/16 inch thick).

D) Standard heavy-duty 12 foot extension ladders.

E) Cable fall breaks, standard commercial.

F) Electric winch, rechargeable.

G) Safety railings (e.g., 1½ inch aluminum pipe, 3/16 inch thick).

H) Plank frame (e.g., 1½ inch aluminum pipe, 3/16 inch thick).

I) Roller assembly, (see details of FIGS. 3A and 3B).

6J) Telescopic standoff arm.

Figure 7:
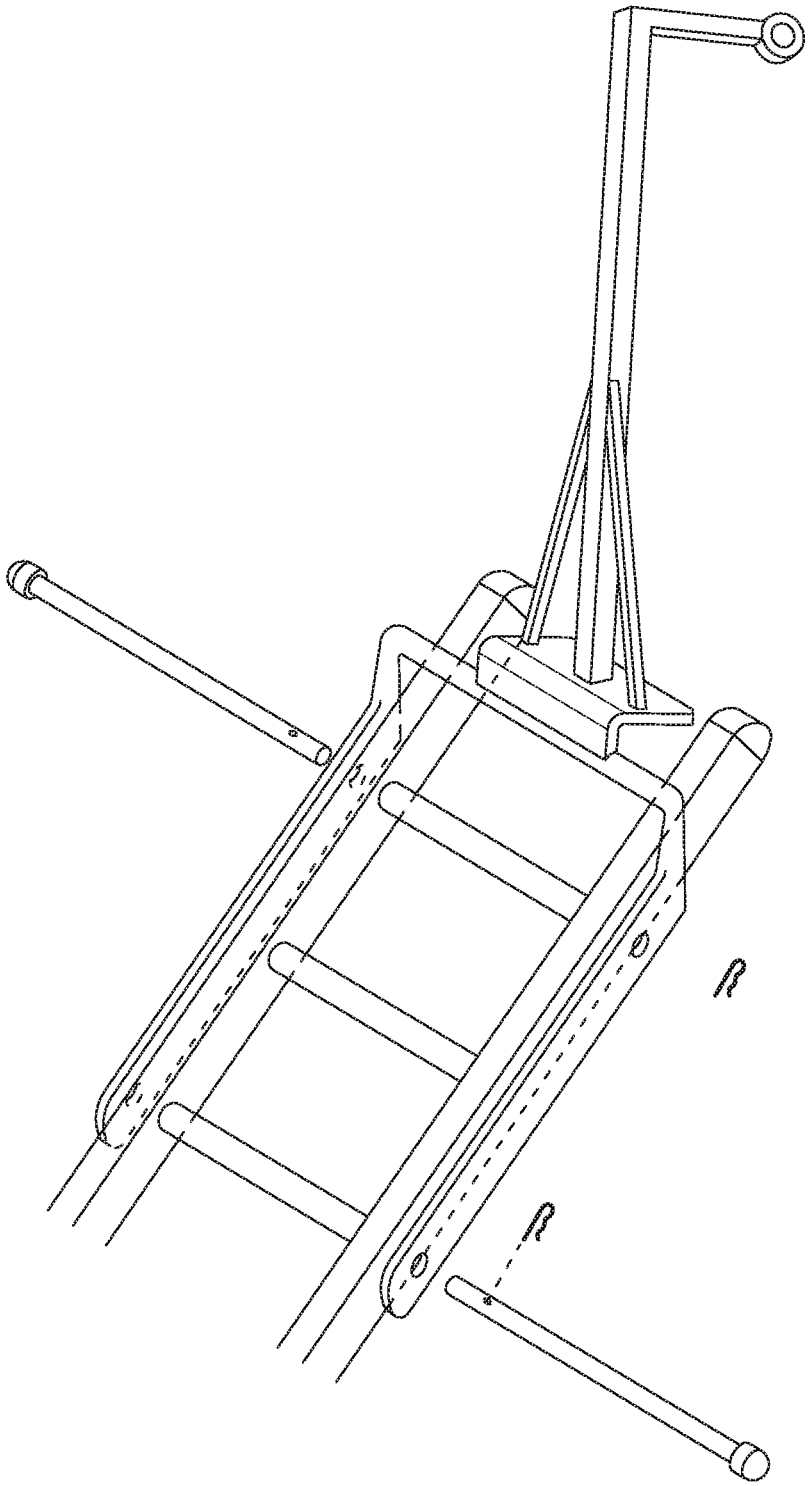
FIG. 7 is a perspective view of an alternative crane assembly which can be detached from the top of each ladder.

FIG. 7 is a perspective view of an alternative crane assembly which can be detached from the top of each ladder. Separate standoffs with extended arms can then be provided for each of the ladders, rather than integrating the crane assembly with the ladder standoff. The alternative crane assembly does not have the ladder rung braces.

Figure 8:
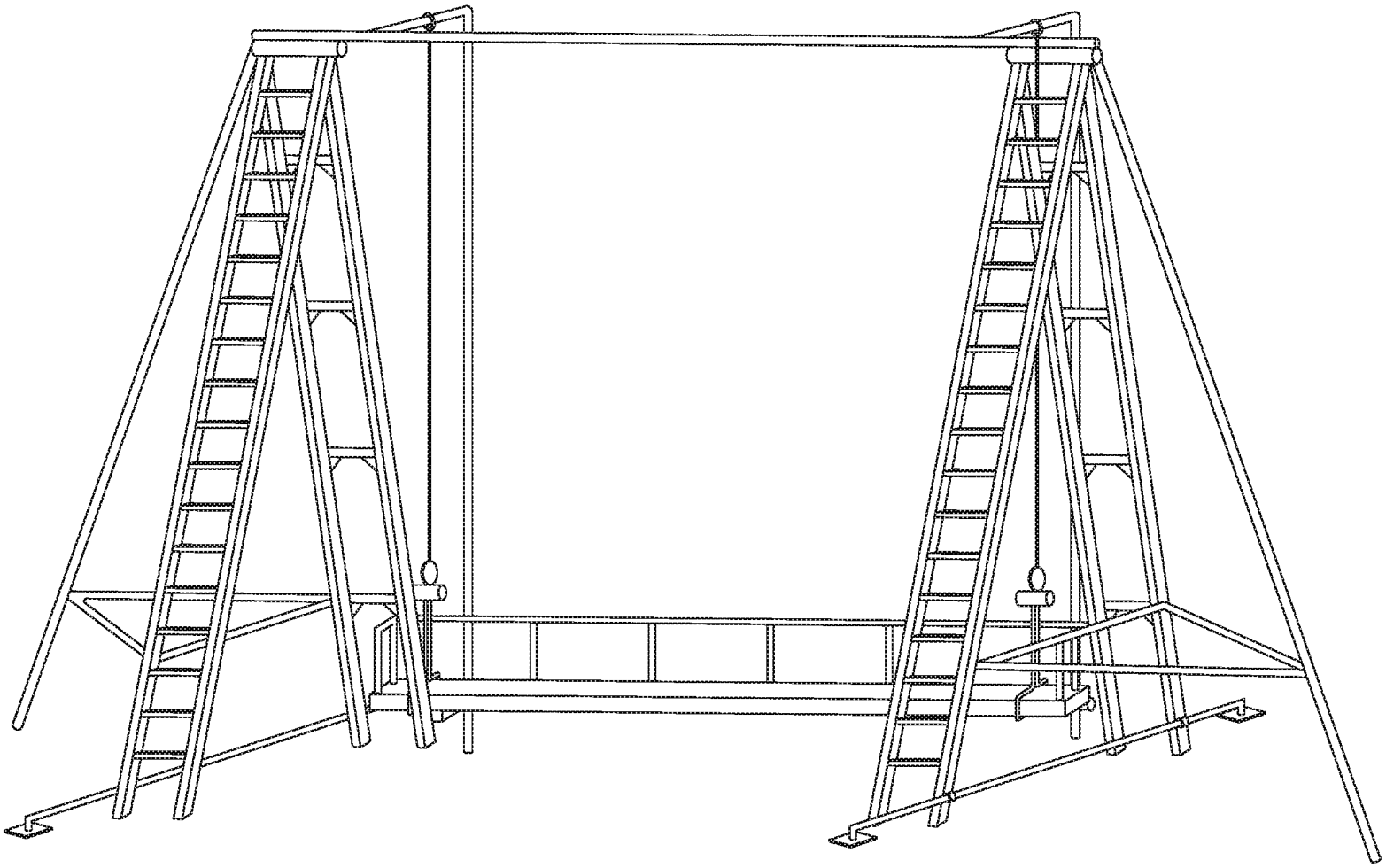
FIG. 8 is a perspective view of a ladder-based plank scaffold system for use with step-ladders.

FIG. 8 is a perspective view of a ladder-based plank scaffold system for use with step-ladders. Consequently, the system need not be propped up against a wall, which is beneficial in cases where the exterior surface of the wall is delicate or otherwise will not support the ladder/standoff weight.

Figure 9:
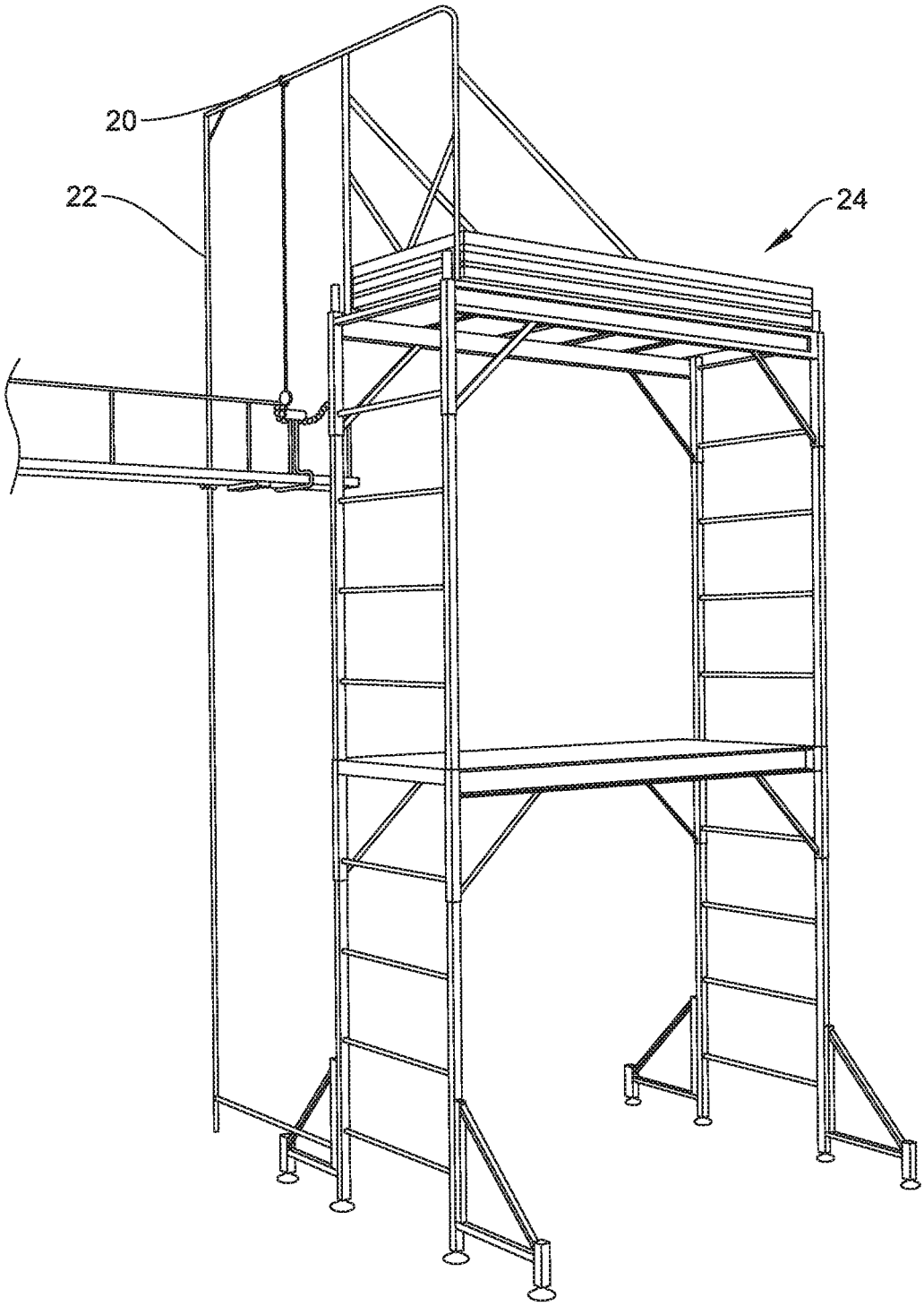
FIG. 9 is a perspective view of a tower scaffold variation of the present application.

FIG. 9 is a perspective view of a tower scaffold variation of the present application. This also is a standalone version that does not rely on support of an adjacent vertical wall. The crane assembly is provided by a horizontal upper bar 20 which leads to a vertical support bar 22. Instead of a ladder on each side, a tower scaffold 24 is used. A tower scaffold 24 may require more time and effort to erect, but provides somewhat greater stability to the entire structure and may be able to reach higher wall surfaces. Although this version is not strictly speaking "ladder-based," it provides a similar portable temporary access structure for a vertically-adjustable plank, and is thus considered a suitable alternative.

Figure 10:
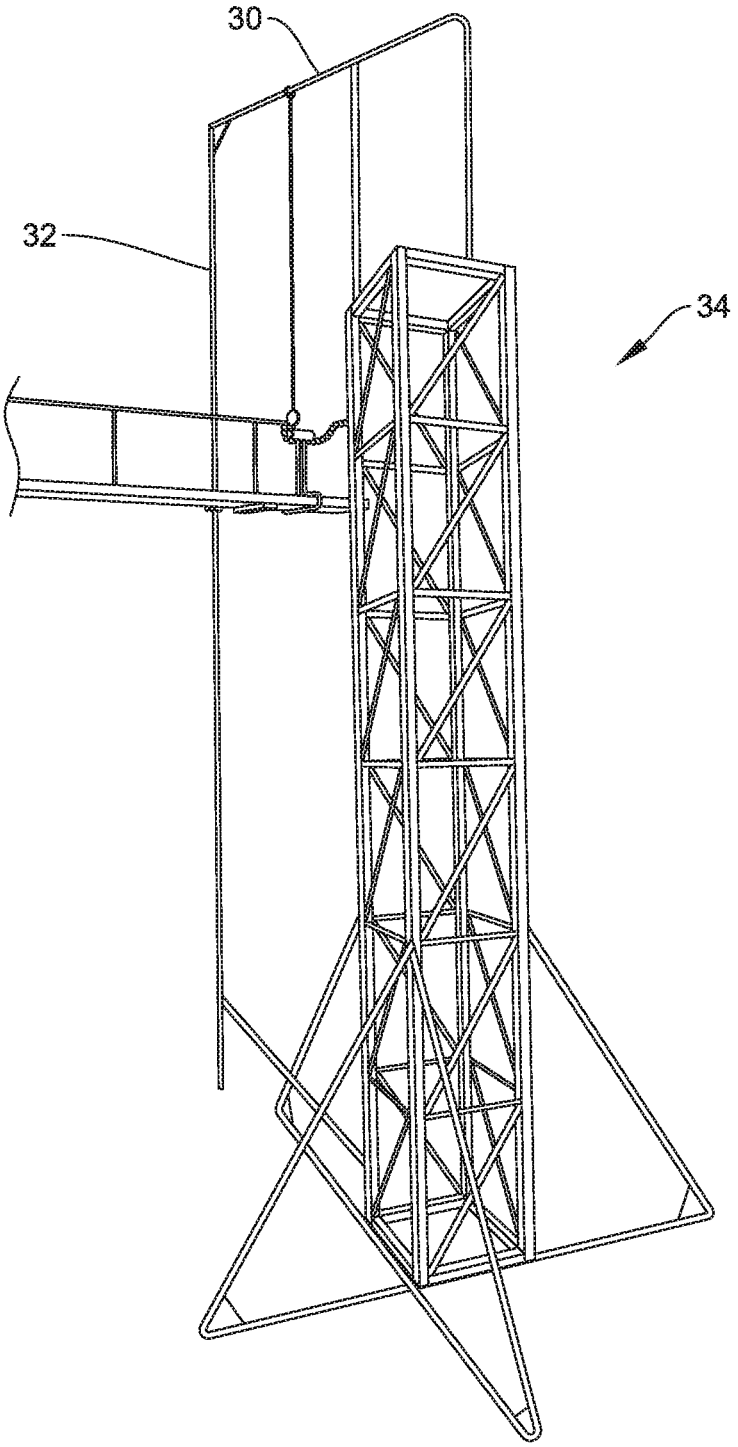
FIG. 10 is a perspective view of a stage tower variation of the present application.

FIG. 10 is a perspective view of a stage tower variation of the present application. The crane assembly is provided by a horizontal upper bar 30 which leads to a vertical support bar 32. Instead of a ladder on each side, a stage tower 34 is used. Although a stage tower 34 may require more time and effort to erect, it provides somewhat greater stability to the entire structure and may be able to reach higher wall surfaces. Again, although this version is not "ladder-based," it provides a similar portable temporary access structure for a vertically-adjustable plank.

Figure 11:
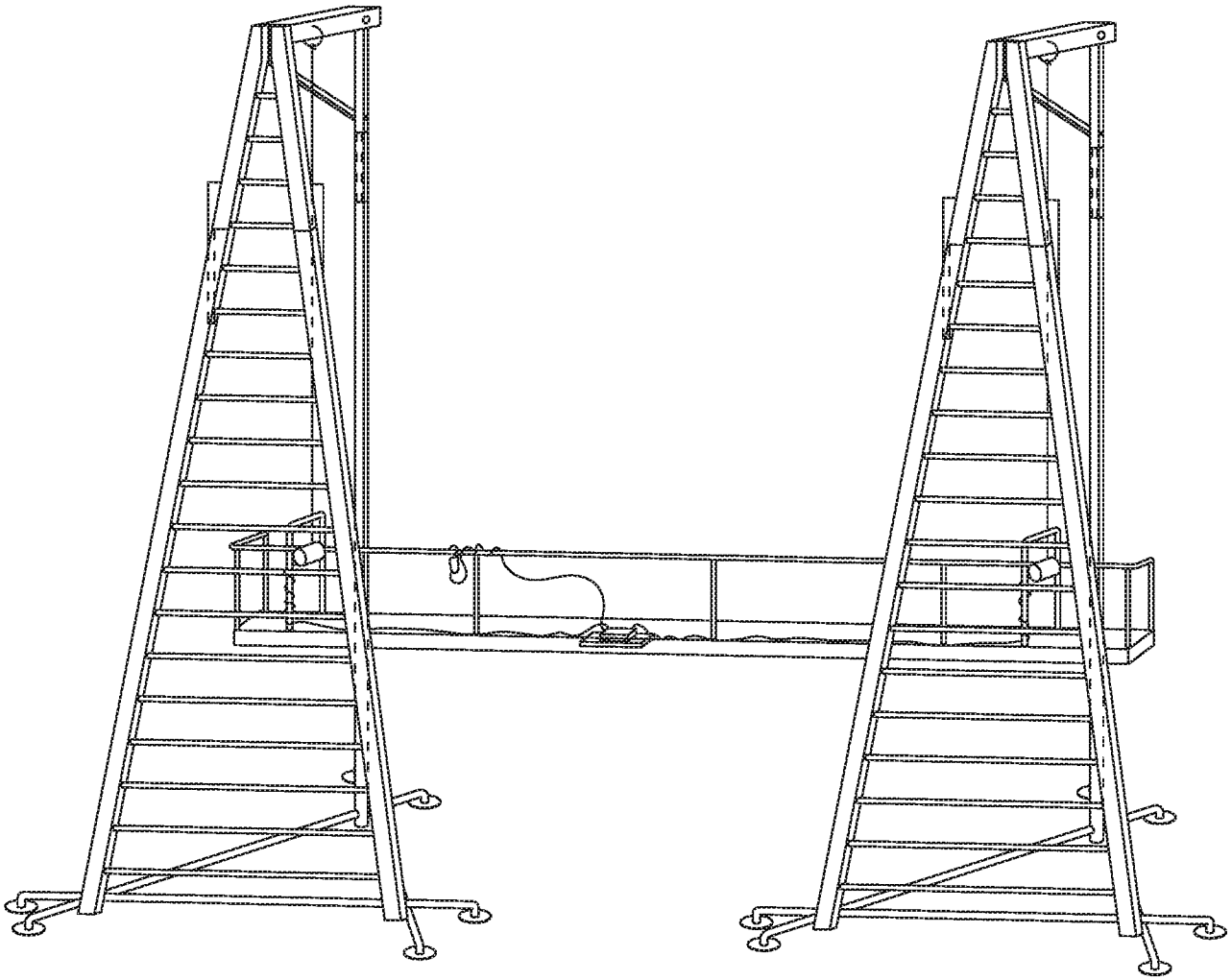
FIG. 11 is a perspective view of a tripod variation of the present application.

Finally, FIG. 11 is a perspective view of a tripod variation of the present application. As with the tower and stage tower variations described above, the use of two tripod-style ladders allows the scaffolding system to be established without need for leaning standoffs against the wall being worked on.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the invention requires features or combinations of features other than those expressly recited in the claims. Accordingly, the present invention is deemed to include all modifications and variations encompassed within the spirit and scope of the following appended claims.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A ladder-based plank scaffold system, comprising:

a pair of ladders;

a wall standoff forming an integrated unit with a crane support and mounted at the top of each of the ladders having a sufficient length to extend from a respective ladder to an adjacent vertical wall, wherein each wall standoff includes a vertical column with two ladder rung braces spaced to rest on top of different rungs of the ladder on which the wall standoff mounts, wherein each integrated unit includes a horizontal portion fixed relative to the vertical column and extending toward the adjacent vertical wall and a cable attachment ring depends down from the horizontal portion, and each integrated unit has two horizontally spaced apart arms fixed relative to the vertical column and extending horizontally to the adjacent vertical wall;

and a horizontal platform suspended on cables below the crane supports, the platform having a pair of cable winches mounted thereon and operatively engaging the cables for varying the elevation of the platform, wherein the cables for the cable winches are secured to the cable attachment rings.

2. The system of claim 1, wherein each wall standoff includes a pair of side lace plates for each of the ladder rung braces with apertures for passage of an elongated cotter pin to lock the crane support to the ladder.

3. The system of claim 1, wherein each of the two horizontally spaced apart arms has an adjustable length.

4. The system of claim 1, further including a pair of vertically spaced horizontal stabilizer bars extending from each of the ladders toward the adjacent vertical wall and connected to a vertical roller guide bar positioned adjacent the vertical wall, the horizontal platform including a pair of roller assemblies each of which engages and is configured to slide or roll up and down along one of the roller guide bars.

5. The system of claim 4, wherein each roller assembly includes a pair of rollers that are movable with respect to one another to enable each pair of rollers to be assembled over the roller guide bar.

6. The system of claim 1, wherein each cable winch includes an electric winch and a cable fall brake.

7. A ladder-based plank scaffold system, comprising:

a pair of ladders;

a crane support mounted at the top of each of the ladders;

a pair of horizontal stabilizer bars extending from each of the ladders toward the adjacent vertical wall and connected to a vertical roller guide bar; and a horizontal platform suspended on cables below the crane supports, the horizontal platform including a pair of roller assemblies each of which engages and is configured to slide or roll up and down along one of the roller guide bars, the platform having a pair of cable winches mounted thereon for varying the elevation of the platform.

8. The system of claim 7, further including a wall standoff mounted at the top of each of the ladders comprising two horizontally spaced apart arms that extend horizontally from each of the ladders and have a sufficient length to extend from a respective ladder to an adjacent vertical wall, wherein the crane support forms an integral part of the wall standoff.

9. The system of claim 8, wherein each crane support defines a horizontal portion extending toward the adjacent vertical wall, and a cable attachment ring depends down from the horizontal portion, wherein the cables for the cable winches are secured to the cable attachment rings.

10. The system of claim 8, wherein the wall standoff arms each have an adjustable length.

11. The system of claim 8, wherein each wall standoff includes a vertical column with two ladder rung braces spaced to rest on top of different rungs of the ladder on which the wall standoff mounts, and the two horizontally spaced apart arms are connected to the vertical column.

12. The system of claim 11, wherein each wall standoff includes a pair of side lace plates for each of the ladder rung braces with apertures for passage of an elongated cotter pin to lock the crane support to the ladder.

13. The system of claim 8, wherein each crane support comprises an upper one of the horizontal stabilizer bars.

14. The system of claim 7, wherein each roller assembly includes a pair of rollers that are movable with respect to one another to enable each pair of rollers to be assembled over one of the roller guide bars.

15. The system of claim 7, wherein each crane support comprises an upper one of the horizontal stabilizer bars.

16. The system of claim 7, wherein each ladder comprises a stand-alone unit selected from the group consisting of a step-ladder, a tripod-style ladder and a tower.

* * * * *